United States Patent [19]

Gawell

[11] Patent Number: 4,733,486

[45] Date of Patent: Mar. 29, 1988

[54] SIGN APPARATUS

[75] Inventor: Sten Gawell, Stenungsund, Sweden

[73] Assignee: Indel AB, Stenungsund, Sweden

[21] Appl. No.: 841,213

[22] Filed: Mar. 19, 1986

[30] Foreign Application Priority Data

Mar. 20, 1985 [SE] Sweden ..... 8501378

[51] Int. Cl.[4] ..... G09F 3/04

[52] U.S. Cl. ..... 40/451; 40/550; 40/564

[58] Field of Search ..... 40/451, 450, 447, 550, 40/541, 564, 570, 551-563, 546, 452; 340/815.31

[56] References Cited

U.S. PATENT DOCUMENTS

| | | | |
|---|---|---|---|
| 262,417 | 8/1882 | Irwin | 40/551 |
| 894,509 | 7/1908 | Leopold | 40/562 |
| 1,805,209 | 5/1931 | Ellern | 40/562 |
| 2,221,606 | 11/1940 | Piacentini | 160/135 X |
| 2,230,152 | 1/1941 | Wolfrey | 40/451 |
| 2,286,246 | 6/1942 | Yearta | 40/546 X |
| 3,163,949 | 1/1965 | Gley | 40/452 |
| 3,187,320 | 6/1965 | Kupsky | 40/451 |
| 3,570,158 | 3/1971 | Hackett | 40/452 |
| 3,786,499 | 1/1974 | Jankowsky et al. | 340/815.31 |
| 4,254,453 | 3/1981 | Mouyard et al. | 40/550 |
| 4,603,496 | 8/1986 | Latz et al. | 40/452 |

FOREIGN PATENT DOCUMENTS

| | | | |
|---|---|---|---|
| 2259641 | 6/1973 | Fed. Rep. of Germany | 40/451 |
| 3146480 | 6/1983 | Fed. Rep. of Germany | 40/452 |
| 2414768 | 9/1979 | France | 40/547 |
| 328971 | 6/1930 | United Kingdom . | |
| 301913 | 7/1930 | United Kingdom . | |
| 1188537 | 4/1970 | United Kingdom . | |
| 2131589 | 6/1984 | United Kingdom . | |
| 2144254 | 2/1985 | United Kingdom . | |

*Primary Examiner*—Gene Mancene
*Assistant Examiner*—James R. Hakomaki
*Attorney, Agent, or Firm*—Banner, Birch, McKie & Beckett

[57] ABSTRACT

A sign apparatus includes a sign cabinet with a window (4) inclined towards the observation plane. Inside the window, which is a color filter, there is arranged a panel (5) with electrically driven character elements (7). The angle of inclination ($\beta$) of the panel is equal to, or less than, the angle of inclination ($\alpha$) of the window. Each character element is formed by obliquely disposed rows of light emitting diodes.

6 Claims, 3 Drawing Figures

SIGN APPARATUS

TECHNICAL FIELD

Figure 1:
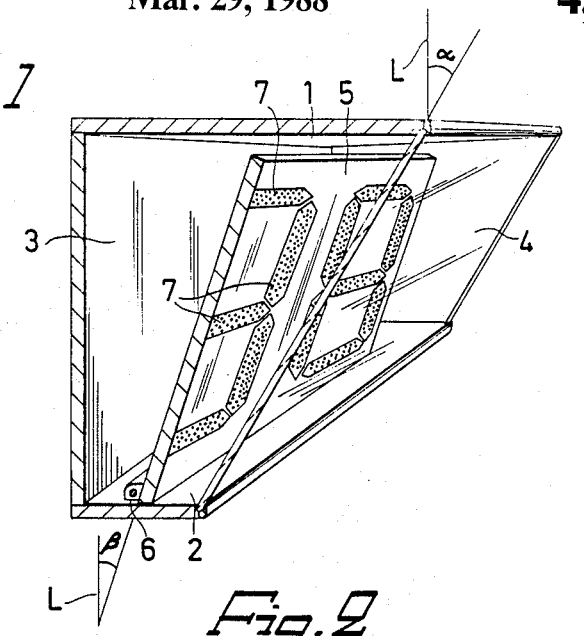

The present invention relates to a sign apparatus for text and/or numeral display outdoors. The apparatus includes electrically driven character elements arranged on a panel which may be illuminated or extinguished from a remote operating unit. The character elements are grouped such as to form different characters when different combinations of the elements are illuminated.

BACKGROUND ART

Sign apparatus of this kind has been implemented with electrical illuminating means such as filament lamps, neon tubes and the like, for it to be readable at large distances, e.g. when it is erected at a relatively large height above the plan of view where the observer is. Apart from such illuminating means having a relatively short life they are also power-consuming.

Electrically driven filament lamps which may be illuminated and extinguished are customarily used for sign apparatus having jumping characters. Since these light sources have short life due to the repeated illumination and extinguishing there have been attempts to utilize light emitting diodes (LED's) for them. Primarily for reasons of expense, matrices have been used in such cases, placed one after the other with a predetermined number of LED's arranged within a given area. There are thus available rectangular matrices with $7\times9$ LED's, i.e. nine columns each having seven LED's. However, it has been found that such LED signs have poor illumination effect.

DISCLOSURE OF THE INVENTION

The object of the present invention is to provide a sign apparatus which is strongly illuminating, easily readable at a large distance and having electrically driven character elements which require little power and have long life. A further object is that the apparatus may also be read when there is strong incident light on it, i.e. when the observer has the sun behind him so that it shines into the panel of the apparatus with the characters thereon. This latter is a particularly troublesome problem when the sun is near the horizon.

The above objects are achieved by mounting the panel in a sign cabinet made with a roof and having a window arranged at a predetermined angle to the vertical, so that the surface of the window is inclined towards the observation plane, and by the panel being arranged inside the window at an angle to the vertical which is equal to or preferably less than the angle of inclination of the window.

It is possible to utilize character elements with the sign apparatus in accordance with the invention. In their basic embodiments the character elements used are of a known kind, seven of them being customarily used in a group to form different characters by illuminating certain elements. Such known character elements are often used for smaller displays and are relatively weakly illuminated. In the sign apparatus according to the invention, the character elements are however built up from LED's, which are distributed in rows and tightly packed on the character element. By arranging these rows at an angle to the longitudinal axis of the element and allowing each row to include 3–6 LED's there is obtained a strongly illuminated character field seen from the observer. In such a case the window is made from a colour filter material.

The inventive sign apparatus has a window with an angle of inclination attaining 15°–45°, preferably 20°–30°, and a panel with an angle of inclination of 0°–20°. The inclination of the panel is advantageously regulatable by it being pivotably mounted, e.g. at the floor of the cabinet.

PREFERRED EMBODIMENTS

Figure 2:
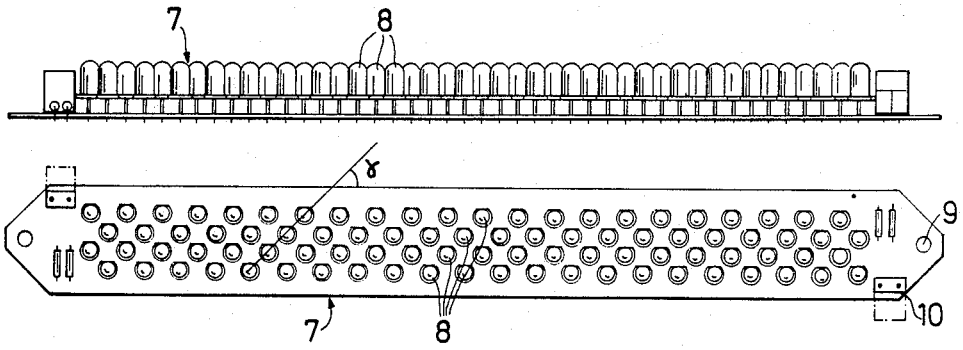
Figure 3:
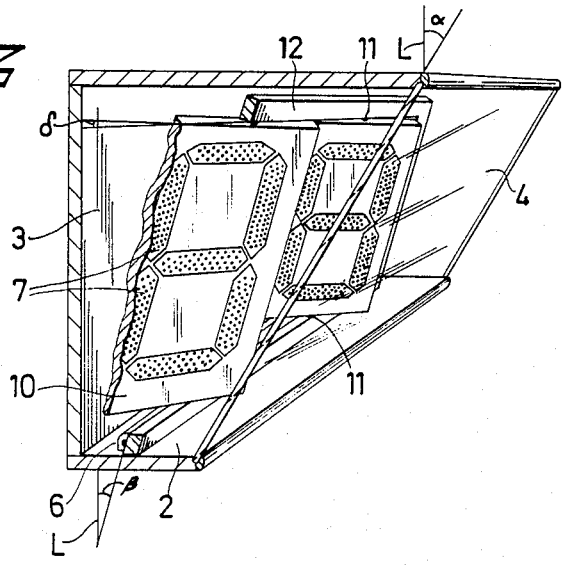

The invention will now be described in detail with reference to the accompanying drawing illustrating preferred embodiments of the invention, where FIG. 1 is a sectioned perspective view of the apparatus in accordance with the invention, FIG. 2 shows in elevation and plan a character element for the signs arranged on the panel of the apparatus, and FIG. 3 is a section similar to the one in FIG. 1 of a modified embodiment of the inventive sign apparatus.

The sign apparatus in accordance with the invention includes, as will be seen from FIG. 1, a sign cabinet with a roof 1 and a floor 2 connected to each other by side walls and a rear wall 3. The cabinet is intended to be mounted at a relatively great height above the observation plane on which the observer stands. Facing towards the observation plane the cabinet has a window 4 in the form of a colour filter, with its surface inclined to the observation plane. A panel 5 is arranged inside the window 4, with an inclination which is adjustable by the panel being mounted on trunnions, indicated in FIG. 1 by the reference numeral 6 at the floor 2 of the cabinet.

The panel 5 carries a plurality of character elements 7, which are electrically driven and comprise illuminable and extinguishable surfaces intended to form a desired character, a letter or a numeral. The elements 7 are arranged in a manner known per se for forming text/numerical messages.

A character element 7 is depicted in FIG. 2, and in accordance with the invention it has a dot raster surface formed by LED's 8 arranged in rows, each LED projecting out at right angles from the base plane of the element 7, the plane being a circuit board for the electrical connection of the LED's 8. In the illustrated embodiment each row includes four LED's 8 mounted close to each other laterally and is disposed at an angle $\gamma$ to the longitudinal axis of the element 7. The element has snap-on and locking means 9, 10 for rapid fitting to the panel 5.

It will be seen from FIG. 1 that the window 4 forms an angle $\alpha$ to the vertical L. This angle $\alpha$ is disposed such that the surface of the window 4 will optimally refract eventual sun rays incidents thereon to the ground surface. This effect combined with the effect of the panel 5 with its character elements 7 formed by LED's 8 and having an inclination $\beta$ to the vertical L give a strongly luminant text/numeral message, even when the observer has the sun at his back. The angles $\alpha$ and $\beta$ are adjusted for the height above the observation plane at which the cabinet is mounted, and also the mutual angular relationship between window 4 and panel 5. The window angle $\alpha$ is preferably 20°–30° and the panel angle $\beta$ is preferably 15°. The focus for each LED lens system is thus directed towards a given point on the observation plane, and sun radiation is refracted towards the observation plane where it is incident at a line closer to the sign apparatus, and thus does not disturb the observer.

A modified embodiment of the sign apparatus in accordance with the invention is illustrated in FIG. 3. In certain situations it may be desirable to direct each individual character towards a common point situated remote from the apparatus in order that optimum readability will be achieved. For example, a sign apparatus may be set up along a road going in a curve past the location of the apparatus. In order to obtain a sharp picture of the message communicated by the sign apparatus at a predetermined point on the road (which is the "observation plane") each individual character carrier member 10 is directed at a given angle $\delta$ towards the surface of the panel 5. This angle $\delta$ is thus different by a small amount for each carrier member 10.

This is achieved, in accordance with the preferred modified embodiment of the sign apparatus, by the panel 5 being formed as a frame 12 with a plurality of carrier members 10 corresponding to the desired number of characters. In the same way as the panel 5 in FIG. 1 the frame 12 is inclined at an angle $\beta$ to the vertical L. This angle of inclination $\beta$ may be regulatable with the aid of trunnions 6 as described above.

The carrier members 10 are individually pivotably mounted in the frame 12, e.g. on journaling pins or a journaling shaft 11, such as to assume said angle $\delta$. The angle $\delta$ usually attains a value of between 0° and 10° and is limited, inter alia, by the fact that the member 10 hides characters behind it if the angular deviation is greater (if these members 10 are not disposed at greater mutual spacing, which is unsuitable with reference to readability and the total length of the sign apparatus). A further limitation of the angle $\delta$ is the bottom depth of the sign cabinet. There are here certain optimum relationships which are that the panel 5/frame 12 are not disposed too far behind the window 4 and that the relationship between the angles $\alpha$ and $\beta$ is adjusted to the height of the cabinet above the observation plane.

There is thus obtained with the sign apparatus in accordance with the invention a strongly illuminated sign display with electrically driven LED's, all together having low energy consumption.

Although two preferred embodiments have been described above in conjunction with the Figures, the invention is not to be regarded as limited thereto. The sign apparatus may be modified in different ways without departing from the inventive concept. For example, the panel 5 may be rigidly mounted at a predetermined angle of inclination $\beta$. Alternatively, the panel 5 may be mounted on pivot arms projecting from the end walls such as to provide an adjustable angle of inclination $\beta$. The character elements 7 may have rows including between three and six LED's 8, which partly depends on the dimensions of the desired characters and partly on the distance between the observer and the apparatus.

I claim:

1. Sign apparatus intended for text and/or numerical display outdoors and including electrically driven character elements (7) each comprising rows of LED's defining a dot raster surface disposed on a panel (5), the former being illuminable and extinguishable from a remotely placed operating unit, and grouped such that different illuminated combinations form different characters, characterized in that the panel (5) is mounted inside a sign cabinet formed with a roof (1), intended for erection at a relatively great height above the observation plane where the observer stands, and has a window (4) comprising a color filter at a distance in front of the panel (5), said window (4) being disposed at a predetermined angle ($\alpha$) of approximately twenty to thirty degrees to the vertical, so that the surface of the window is inclined towards the observation plane, the panel (5) being disposed inside the window at an angle ($\beta$) of approximately fifteen degrees to the vertical and being mounted for pivotal movement to adjust said angle of inclination ($\beta$).

2. Apparatus as claimed in claim 1, characterized in that the panel (5) includes a frame (12) adapted for carrying a plurality of individual carrier members (10) corresponding to the number of desired characters, each member carrying character elements (7) for forming different characters and which members are individually pivotable about a vertical pivoting axis (11) in the frame (12) for assuming a converging angle ($\delta$) to a point on the observation plane situated at a distance.

3. Apparatus as claimed in claim 2, characterized in that the converging angles ($\delta$) is between 0°–10°.

4. Apparatus as claimed in claim 1, characterized in that the LED's (8) of each character element (7) are arranged in rows which form an acute angle ($\gamma$) to the longitudinal axis of the character element, each row including 3–6 LED's.

5. Apparatus as claimed in claim 1, characterized in that the depth of the roof (2) and floor (1) of the sign cabinet are predetermined by the angle of inclination ($\alpha$) of the window (4) to the observation plane, the window being fastened to the free outer edges of the roof and floor.

6. Apparatus as claimed in claim 1, characterized in that the mounting of the panel (5) is arranged at the floor (1) of the cabinet.

* * * * *